United States Patent [19]

Manella

[11] Patent Number: 4,746,279

[45] Date of Patent: May 24, 1988

[54] HOSE PUMP

[75] Inventor: Paul Manella, Dübendorf, Switzerland

[73] Assignee: Doltron AG, Dübendorf, Switzerland

[21] Appl. No.: 859,001

[22] Filed: May 2, 1986

[30] Foreign Application Priority Data

May 2, 1985 [CH] Switzerland ..... 1864/85

[51] Int. Cl.[4] ..... F04B 43/12; F04B 45/08

[52] U.S. Cl. ..... 417/474; 248/231.3; 248/316.2; 403/4

[58] Field of Search ..... 417/44, 474–477; 403/4, 359, 383; 248/231.3, 316.2

[56] References Cited

U.S. PATENT DOCUMENTS

| | | | |
|---|---|---|---|
| Re. 22,924 | 10/1947 | Mades | 403/4 X |
| 1,145,587 | 7/1915 | Hitchcock | 403/4 |
| 2,058,102 | 10/1936 | Philipp | 248/316.2 |
| 2,363,638 | 11/1941 | Brelsford | 248/316.2 X |
| 2,689,530 | 9/1954 | Harvey | 417/474 |
| 2,958,559 | 11/1960 | Jensen | 248/231.3 |
| 3,951,371 | 4/1976 | Hoes | 248/231.3 X |
| 4,118,000 | 10/1978 | Campbell | 248/231.3 X |
| 4,302,164 | 11/1981 | Manella | 417/474 |
| 4,380,236 | 4/1983 | Norton | 417/44 X |
| 4,479,797 | 10/1984 | Kobayshi et al. | 417/474 X |

FOREIGN PATENT DOCUMENTS 633352 12/1978 Fed. Rep. of Germany .

*Primary Examiner*—William L. Freeh
*Assistant Examiner*—Theodore Olds
*Attorney, Agent, or Firm*—Charles E. Brown; Charles A. Brown

[57] ABSTRACT

The hose pump has plates forming the first pressure members and limbs which form second pressure members and which are actuated by the plates. The limbs are fastened at one end to a base plate, in such a way that second portions formed at the other ends are parallel to and near one another and the surfaces, facing one another, of the middle portions are inclined towards one another, in order to move the limbs to-and-fro by means of the projections of the plate. By means of resilient elements which on the one hand rest against webs in the frame and on the other hand against the plate, the plate is held in contact with the drive. As a result of these measures, the efficiency and the effect of the hose pump can be improved.

2 Claims, 2 Drawing Sheets

HOSE PUMP

BACKGROUND OF THE INVENTION

The present invention relates to the pumping art and more specifically concerns a new and improved construction of a hose pump containing a first pressure member movable to-and-fro with respect to a counter pressure surface and a second pressure member movable to-and-fro with respect to a hose. The pressure elements are arranged next to one another and are driven by a common drive in order to rhythmically compress the hose within two neighboring regions and thus to convey the medium which is to be pumped.

DESCRIPTION OF THE PRIOR ART

In the case of hose pumps, a hose is rhythmically compressed in sections for the purpose of conveying a fluid medium. To this end the hose pump is either equipped with one or a number of squeeze rolls, arranged at a rotatable body, and a hose arranged at a circular arcuate-shaped surface, or with a number of adjacently arranged punches with are moved to-and-fro by cams and a flat or planar counter element. Conveying of the fluid medium is accomplished either by the rotating squeeze rolls or by successive contact of the punches against the counter element, so that the hose is continuously pressed in a peristaltic movement.

From U.S. Pat. No. 4,302,164 a hose pump having first and second pressure members is known. This hose pump has a first pressure member designed as a plate and a fork-shaped second pressure member consisting of a yoke and of two legs, the legs having middle portions which are assigned to one another and which are connected operatively to the plate, in order to actuate the legs in dependence on the plate, in a direction transverse relative to the direction of movement of the plate, so that the hose cross-section is varied successively in two directions transverse relative to one another.

Experience has shown that the fork-shaped second pressure members are exposed to large loads and subjected to pronounced mechanical wear. This wear is attributable to the continuously identical bending of the two legs at the same region. Due to the fork-shaped construction of the second members the manufacturing of these members is more complicated and higher in cost.

SUMMARY OF THE INVENTION

Therefore, with the foregoing in mind, it is a primary object of the present invention to provide an improved construction of the hose pump which is not afflicted with the aforementioned drawbacks and limitations of the prior art.

Another object of the present invention aims at a new and improved design of a hose pump which is structured such that the wear of the second pressure member is minimized.

A further object of the present invention relates to a new and improved construction of a hose pump which is simple in design and thus is simpler to assemble and maintain, and its efficiency and pumping effect are greater.

In order to implement these and still further objects of the invention which will become more readily apparent as the description proceeds, the improvement of the present invention is manifested by the features that resilient elements are assigned to the first pressure members in order to generate a force assisting the movement of the first pressure members, and that the limbs forming the second pressure member are fastened to a baseplate in order to reduce the force to be applied for moving the limbs to-and-fro by means of the second pressure members.

Some of the notable advantages which are realized with the invention reside essentially therein, that an improvement of the pumping effect of the hose pump can be achieved, if there are two webs mounted on the side walls and the resilient elements rest at one end against the web and at the other end against the second pressure member, and if there is a sensing device in order to sense the position of at least one first pressure member relative to a counter-pressure surface.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
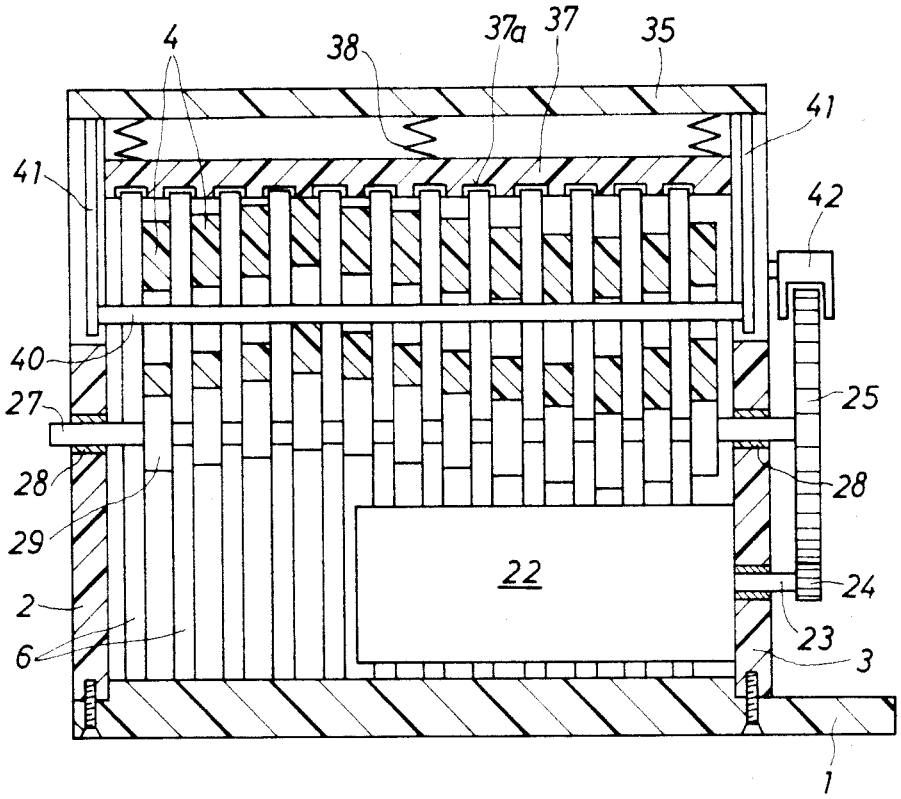
FIG. 1 shows a longitudinal section through an exemplary embodiment of a hose pump according to the invention.
Figure 2:
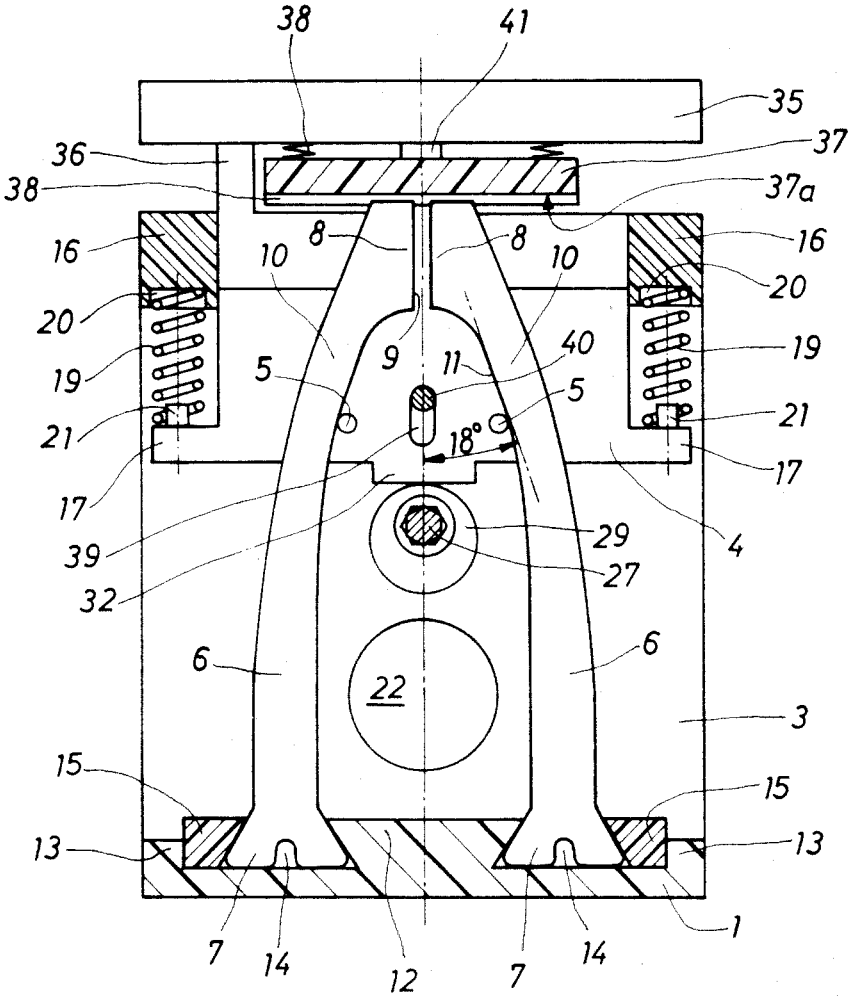
FIG. 2 shows a section along the line II—II in FIG. 1.

The hose pump shown in FIGS. 1 and 2 is designed as a plug-in rack unit and has a frame which consists essentially of a rectangular baseplate 1 and two side walls 2, 3 fastened to the narrow sides of the baseplate 1.

The hose pump has twelve first and second pressure members which act as limbs under compression and which are arranged resting against one another. The first pressure member is designed as an essentially rectangular plate 4 which has two projections 5 on the side facing the second pressure member. The second pressure member is formed by two limbs 6 which are of identical design. The limbs 6 are made bar-shaped and have, at one end, a first portion 7 to fasten the limb 6 on the baseplate 1, at the other end, a second portion 8 with a plane surface 9 and, between these, a middle portion 10. The limbs 6 are arranged vertically and are mounted on the baseplate 1 axially symmetrically, so that the plane surfaces 8 are parallel to and near one another and the middle portions 10 face one another, in such a way that the inner surfaces 11, facing one another, of the middle portions 10 each form an angle of approximately 18° relative to the axis of symmetry, and the projections 5 of the plate 4 rest against the inner surface.

The baseplate 1 has a dovetail-shaped projection 12 which is formed in the middle of the baseplate 1 and which extends in the longitudinal direction of the latter. A further projection 13 is formed parallel to the projection 12 on each of the edges of the baseplate 1. The baseplate 1 consists of plastic. The two leg surfaces of the dovetail-shaped projection 12 form the stop surfaces for the first portions 7 of the limbs 6.

The first portion 7 of the limb 6 is likewise dovetail-shaped and matches the projection 12, so that the first portion 7 rests by means of a leg surface against the leg surface of the projection 12. A groove 14 is also formed in the first portion 7. The first portion 7 is fastened on the baseplate 1 by means of a fastening member 15. The fastening member 15 is of the same length as the baseplate 1 and has a trapezoidal cross section. The fastening member 15 thus has two surfaces parallel to one another, a surface lying at right angles to these and a sloping surface, by means of which the fastening member 15 rests against the first portion 7. The cross section of the fastening member 15 is calculated so that it is somewhat larger than the space located between the first portion 7, resting against the projection 12, of the limb 6, and the projection 13 formed on the edge of the baseplate 1. When the fastening member 15 is screwed tightly on the baseplate 1 by means of screws (not shown), the first portion 7 of the limb 6 is compressed slightly. At the same time, this is compensated by the groove 14 in the first portion 7. This fastening method ensures that all the limbs 6 are fastened rigidly on the baseplate 1.

As shown in FIG. 2, the plate 4 is guided on two webs 16 at the edges located opposite one another. The webs 16 are arranged parallel to one another and are fastened to the side walls 2, 3. The plate 4 also has two extensions 17 which project from the opposing edges. Between the web 16 and the extension 17 there is a spring 19 which at one end is arranged in a blind hole 20 in the web 16 and at the other end is attached on a projection 21 on the extension 17 of the plate 4.

The hose pump is driven by an electrical drive 22 which can be a motor or geared motor. Mounted on the drive shaft 23 of the drive 22 is a pinion 24 which is engaged with a gear wheel 25. The gear wheel 25 is mounted on a drive shaft 27 which is supported in bearings 28.

Arranged on the drive shaft 27, at a uniform distance from one another which is somewhat longer than the thickness of the limbs 6, are twelve cam discs 29, against the control surface of each of which rests a plate 4. The cam discs 29 are arranged on the drive shaft 27 in such a way that their vertices are respectively offset 30° relative to one another in the clockwise direction. The drive shaft 27 has a hexagonal cross section and consists of metal.

Figure 3:
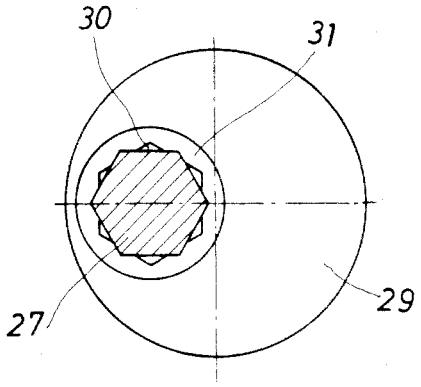
FIG. 3 shows a spatial view illustrating the arrangement of the cam disc on the drive shaft.

As shown in FIG. 3, the cam disc 29 has a hole 30 provided with a toothing. The toothing has a pitch of 30° and is designed so that the cam disc 29 can be pushed onto the drive shaft 27. It is clearly evident from this FIG. 3 that the vertices of the cam discs 29 are offset in a simple and accurate way merely by attaching each cam disc 29 onto the drive shaft 27 so as to be offset the amount of one tooth. The cam disc 29 also has a collar 31 in order to guarantee the distance between the cam discs 20.

As shown in FIG. 2, the control surface of the cam disc 29 rests against an extension 32 formed on the plate 4. This extension 32 can also be omitted.

The hose pump also has a cover 35 which is mounted pivotably on an extension 36 formed on the side wall 2, 3. Fitted to the underside of the mounted cover 35 is a plate 37 which is supported on the cover 35 by means of springs 38 and which forms a counter-pressure surface 37*a*. The plate 37 is provided with grooves 38 which serve for guiding the limbs 6.

As is evident from FIG. 2, the plate 4 has a slot 39, through which a rod 40 extends. This rod 40 is part of a lifting mechanism which, as shown in FIG. 1, also has two levers 41 connected movably to the ends of the rod 40 on the one hand and to the cover 35 on the other hand. By means of this rod 40, when the cover 35 is opened all the plates 4 are lifted into a common upper position and, at the same time, all the limbs 6 are deflected by the projections 5 of the plates 4, so that, in this position, a hose (not shown) can be inserted or a hose inserted in the hose pump can be removed. Moreover, mounted on the cover 35 is a closing device (not shown) which can be made to engage with the corresponding web 16 in order to close the cover 35.

The position and rotational speed of the gear wheel 25 are sensed by an optoelectrical sensing device 42 fastened to the appropriate side wall 3 at a location which does not have to correspond to that shown in FIG. 1. The sensing device 42 can interact with the teeth of the gear wheel 25 or with holes (not shown) provided specially for this purpose in the gear wheel 25. Sensing devices of this type are known and are therefore not described in detail. The sensing device 42 is connected electrically to an electrically operated control device (not shown). By means of this control device, on the one hand the speed of the motor 22 and consequently also the delivery capacity are regulated and on the other hand the speed of the motor is increased briefly, when the first and twelfth plates 4 reach the topmost position jointly, in order to reduce the period of time when the hose portion located between the first and twelfth plates 4 is closed off.

Since the mode of operation is otherwise identical to that described in U.S. Pat. specification No. 9,302,164 of the same assignee, there is no need for a detailed description and the disclosure of which being incorporated by reference.

While there is shown and described a present preferred embodiment of the invention, it is to be distinctly understood that the invention is not limited thereto, but may be otherwise variously embodied and practiced within the scope of the following claims.

I claim:

1. An improved hose pump including a first and a second pressure member which are arranged next to one another, with a drive to drive the pressure members jointly, in such a way that the second member is actuated, in dependence on the first member, in a direction transverse relative to the direction of movement of the first member, in order to vary a hose cross section successively in two directions transverse relative to one another, the first pressure member being a plate which is movable to-and-fro relative to a counter-pressure surface and which is provided with two projections on the side facing the second pressure member, and the second pressure member having two limbs which are movable to-and-fro relative to the hose and have a middle portion and against which the projections rest in order to actuate the limbs, and with a frame, in which the pressure members and the drive are arranged and which has a baseplate, the improvement comprising resilient elements assigned to the plate forming the first pressure member, in order to generate a force assisting the movement of the plate away from the counter-pressure surface; limbs forming the second pressure member of identical design, wherein said limbs are fastened to the baseplate by means of first portions formed at one end, in such a way that second portions formed at the other ends are parallel to and near one another and the surfaces, facing one another, of the middle portions are inclined relative to one another, a projection is formed on the baseplate and against which rest the first portions of the limbs, and two fastening members rest against the first portion of the limbs and are fastened on the baseplate, in order to maintain the limbs on the baseplate, and the first portion is made dovetail-shaped, in such a way that the first portion widens towards the end of the limb.

2. The improvement of claim 1, wherein the first portion is provided with a groove which is formed parallel to the dovetail at the end of the limb.

* * * * *